US005483914A

United States Patent [19]

Wonka et al.

[11] Patent Number: 5,483,914

[45] Date of Patent: Jan. 16, 1996

[54] LONGITUDINALLY EXTENDED FLOATS

[76] Inventors: Justine Wonka; Franziska Pfeiffer; Nicole Pfeiffer, all of Amalieweg 16, D-85551 Kirchheim, Germany

[21] Appl. No.: 290,107

[22] Filed: Aug. 15, 1994

[30] Foreign Application Priority Data

Aug. 17, 1993 [DE] Germany ..... 9312294 U

[51] Int. Cl.[6] ..... B63B 7/00

[52] U.S. Cl. ..... 114/345; 441/129

[58] Field of Search ..... 114/266, 267, 114/345, 352–354, 123; 441/38–40, 65, 35, 66, 129–132, 136; 403/353, 363, 375, 381

[56] References Cited

U.S. PATENT DOCUMENTS

| | | | |
|---|---|---|---|
| 4,598,659 | 7/1986 | Chinnery | 114/123 |
| 4,998,498 | 3/1991 | Gallichan | 114/354 |
| 5,197,404 | 3/1993 | Haley et al. | 114/267 |

FOREIGN PATENT DOCUMENTS

| | | | |
|---|---|---|---|
| 1108752 | 1/1956 | France | 441/129 |
| 365622 | 12/1962 | Switzerland | 114/345 |

*Primary Examiner*—Edwin L. Swinehart
*Attorney, Agent, or Firm*—Rothwell, Figg, Ernst & Kurz

[57] ABSTRACT

A longitudinally extended float includes detachable longitudinal-side attachments for attaching to a substantially identical float. The attachments are connected to respective opposite first and second longitudinal sides of the floats. The attachments are made up of elongated profiles extending substantially parallel to respective opposite first and second sides of the float. Each of the profiles has a generally U-shaped cross-section with leg portions of unequal length, the unequal leg portions including a long leg and a short leg. The long leg is part of a back piece which is attached to a respective longitudinal side of the float, the long leg being connected to the short leg by a bottom portion of the U-shaped profile. The U-shaped profile has an open end opposite the bottom portion. The float attachments further include a fin adjacent the open end of the U-shaped profile which is substantially parallel to the bottom portion of the U-shaped profile. The fin is connected to the back piece, and shields the open end of the U-shaped profile.

13 Claims, 4 Drawing Sheets

LONGITUDINALLY EXTENDED FLOATS

BACKGROUND OF THE INVENTION

1. Field of the Invention

The present invention relates to the field of floats and rafts.

2. Description of the Background Art

There are multiple forms of embodiment of floats for navigation of waters. Their external shape, their material state, and their buoyancy are selected on the basis of the desired field of application.

Floats that can be inflated, of the play and leisure field, such as air mattresses, inflatable boats, pool islands, etc. are characterized by a small intrinsic weight, simple transportability, and small requirement for storage space. Their buoyancy and their useful lying and/or transport surfaces, however, are limited.

Raft-type floats consist of several wood planks or tree trunks arranged parallel to one another and clamped or otherwise joined. Here, it is of advantage that the raft can be enlarged almost arbitrarily simply by adding additional tree trunks. Disadvantages include the time-consuming difficult joining procedure and the high intrinsic weight of the raft module, the longitudinal wood planks; the latter make transport difficult from the assembly site back to the launching site.

SUMMARY OF THE INVENTION

The invention takes on the task, therefore, of creating a float, which is suitable as a "building block" or module for a rapid and simple assembly and disassembly of raft of arbitrarily selected size with bearing capacity for play and sports, and which is easy to transport.

This task is resolved by a longitudinally extended float, which has joining means arranged on its opposite-lying longitudinal sides for detachable longitudinal-side attachment of an identical float. In this way, the float itself takes on the character of a module, so that the formation of a module structure, e.g., in the form of a raft, is possible. Advantageously, the joining means are introduced at the place of maximum cross section or diameter of the float.

Preferably, the joining means consist of extruded profiles, whose profile is configured such that a first profile can be introduced and a second profile can be engaged in the first. Advantageously, these profiles are made of extrudable plastic or hard rubber. Preferably they have a broad base or a back piece, to which the profile is attached to the float, for example, by gluing or by vulcanizing.

Preferably, such an extruded profile has a "U" shaped cross section. Advantageously, this "U" does not have equal side lengths, i.e., it has a long leg and a short leg. The long leg is a component of the above-mentioned base or of the back piece, to which the profile is attached to the float. One of the ends of the long leg changes into the bottom and then into the short leg of the "U" profile. On the other end of the long leg, the latter has a fin-type projection in the region of the opening of the "U", and this projection shields the open side of the "U". An opening remains between the free end of the short leg and the fin-type projection and this leads to inside the "U". This opening extends as a gap over the entire length of the profile. Two profiles of this type can be brought into a rigid engagement in this way. The short leg of a second profile is introduced through the said gap opening into the inside space of the first "U" profile. The two profiles must thus be deformed slightly elastically. In the locked state, they engage in each other, like two hooks. The said fin-type projection on each profile therefore serves as a stop piece for the bottom of the "U" for another profile.

In another preferred form of embodiment, the float has an extruded profile with a slot on one of the longitudinal sides and an analogous profile with a key on the opposite-lying longitudinal side as a fastening means. By engaging these fastening elements, a tight system of floats is created, which can be enlarged arbitrarily by adding additional units. Advantageously, the attachment slot and the attachment key extend essentially over the entire length of the float, whereby a module system created by attaching several floats has a high stability.

In another preferred form of embodiment, the fastening means are divided into corresponding segments, which make possible a segmental engagement of the profiles adapted to one another. This simplifies manipulation in assembly and disassembly of the module system, since with this construction, the frictional forces occurring during joining, for example, of the slot and the key are smaller.

Other advantageous fastening means are slot and key elements in the form of a dovetail connection. Advantageously, a key shaped as a T in cross section, and a slot, which is formed so as to engage with the T profile is particularly formed.

In another advantageous form of embodiment, attachment means are provided also on at least one of the front sides of the float. These means may correspond to the above-named longitudinal-side attachment means, and preferably they are eyes.

In addition to the above-described preferred attachment means, other known means can also be applied, such as plug connections, Velcro tapes, hooks and eyes, etc.

Another advantageous form of embodiment consists of the fact that an attachment slot or an attachment key is introduced on the two opposite-lying longitudinal sides of the float, and the longitudinal-side joining to an identical float can be produced with double-key or double-slot profiles engaged with two slots or two keys. In the assembly, the double-key or double-slot profile is shifted into the corresponding binding element as a joining member between two identical floats.

In the preceding forms of embodiment, it can be assured, if desired, by suitable, generally known components, such as locks or snapping components, that the connections cannot be loosened unintentionally.

Preferably, the float is a hollow unit, particularly a hollow unit that can be inflated with at least two air chambers and corresponding valves. In this way the float can thus be compressed into a small volume after use, which simplifies transportability and keeps storage space requirements small. In addition to the configuration as an inflatable hollow unit, solid units can also be used, which have the necessary buoyancy with the smallest possible intrinsic weight, such as, e.g., plastic foams.

Advantageously a raft can be produced by longitudinal-side, detachable joining of at least two floats of the type described here. The weight of this raft can be arbitrarily varied by using the appropriate number of floats. Such a raft can be used for many purposes. In addition to navigation of waters, it may also be used as a stationary platform on seas or marine waters, e.g., it may be used as a base for swimmers or surfers. A particular form of embodiment of the raft consists of the fact that two or more floats are joined by a rigid spacer at least on their front and back ends, and a bottom element is attached to or onto the spacers.

Current plastic materials are particularly suitable as the outer material of the float, which [materials] make available the necessary properties, such as, e.g., ultimate tensile strength. Preferably, the plastic materials should be flexible and, as the case may be, possess resistance to sea water. At least one surface of the float is preferably made into a profile in order to obtain a non-skid surface.

All current shapes, which serve for the purpose of the float, are suitable as shapes for the cross section of the float. In particular, these are circular, oval, rectangular, or triangular cross sections. The attachment means are introduced advantageously on those longitudinal edges of the float that serve as natural joining edges in the parallel arrangement of several floats of the type described here. This simplifies the formation of a continuous surface of the module system.

Advantageously, the front sides of the float can be shaped in a blunt or random keel shape, according to whether, e.g., a protection against passing waves or a form that is as favorable to the current as possible is desired. In addition, attachment means can be introduced onto the surface of the float in order to be able to attach e.g., seating units, reeling apparatus, an anchor line, or a mooring rope.

BRIEF DESCRIPTION OF THE DRAWINGS

Several forms of embodiment given by way of example are shown in the following FIGS. 1–8.

DESCRIPTION OF THE PREFERRED EMBODIMENTS

Figure 1:
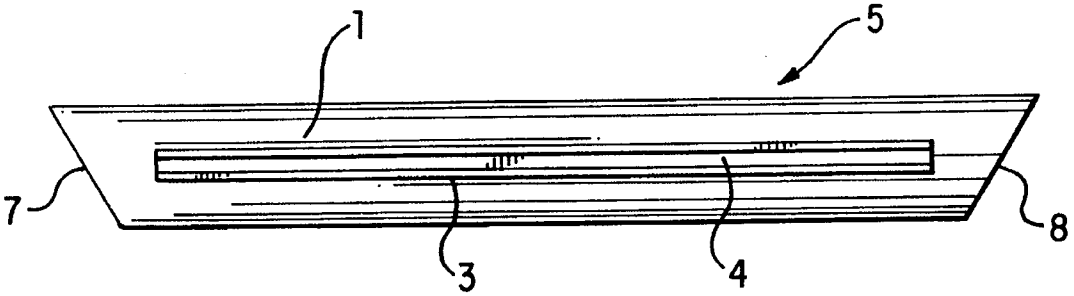
FIG. 1 shows the side view of a float according to the invention.
Figure 5:
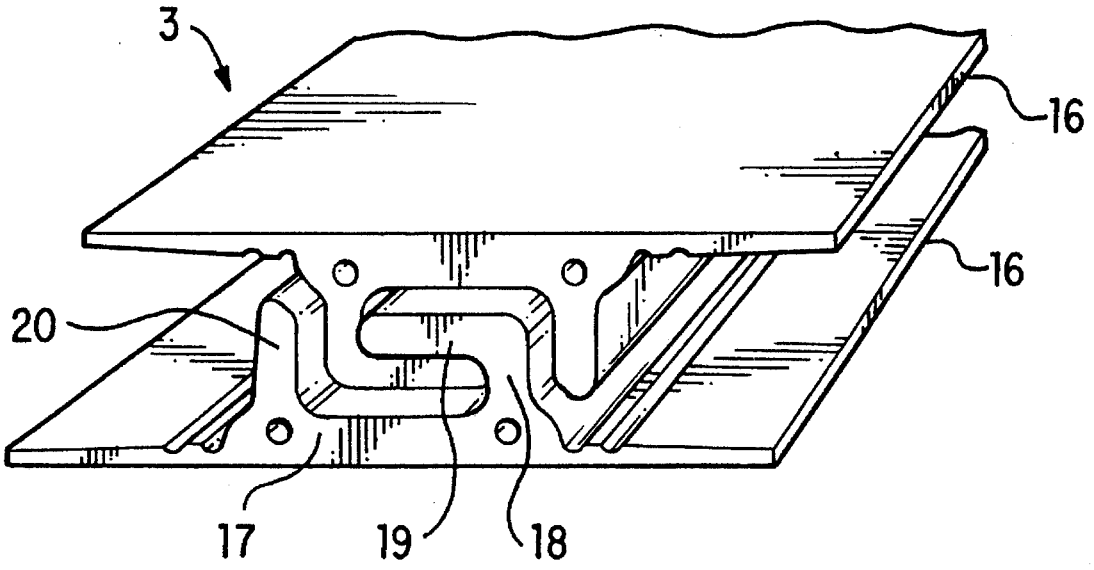
FIG. 5 shows a front view in perspective of two identical extruded profiles according to the invention, which have a "U"-shaped cross section and engage with each other.
Figure 6:
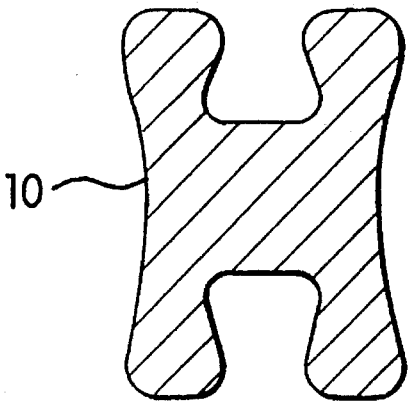
FIG. 6 shows a double-key profile in cross section according to the invention.
Figure 7:
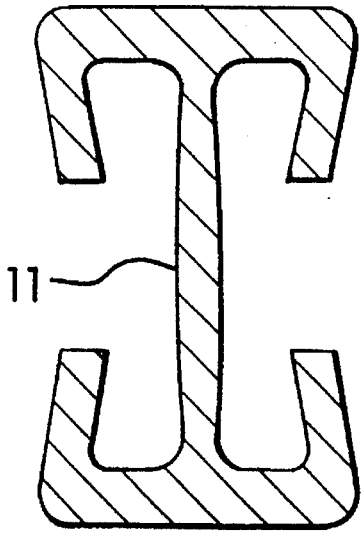
FIG. 7 shows a double-slot profile according to the invention in cross section.

FIG. 1 shows a side view of a float (S). Joining means (3), by means of which identical floats can be attached in detachable manner on the longitudinal side, are introduced on the opposite-lying longitudinal sides (1,2). These fastening means extend over the entire length of the float. Preferably, these are extruded profiles of plastic or hard rubber, which have a slot (4) or a key (5) engaging in this slot. In the preferred form of embodiment of a circular cross section, joining means (3) are introduced on both sides at the place of maximum diameter. The front sides (7, 8) are tapered. Particularly advantageous joining means, which can be used instead of the extruded profile with slot (4) or key (5) are shown in FIGS. 5–7.

Figure 2:
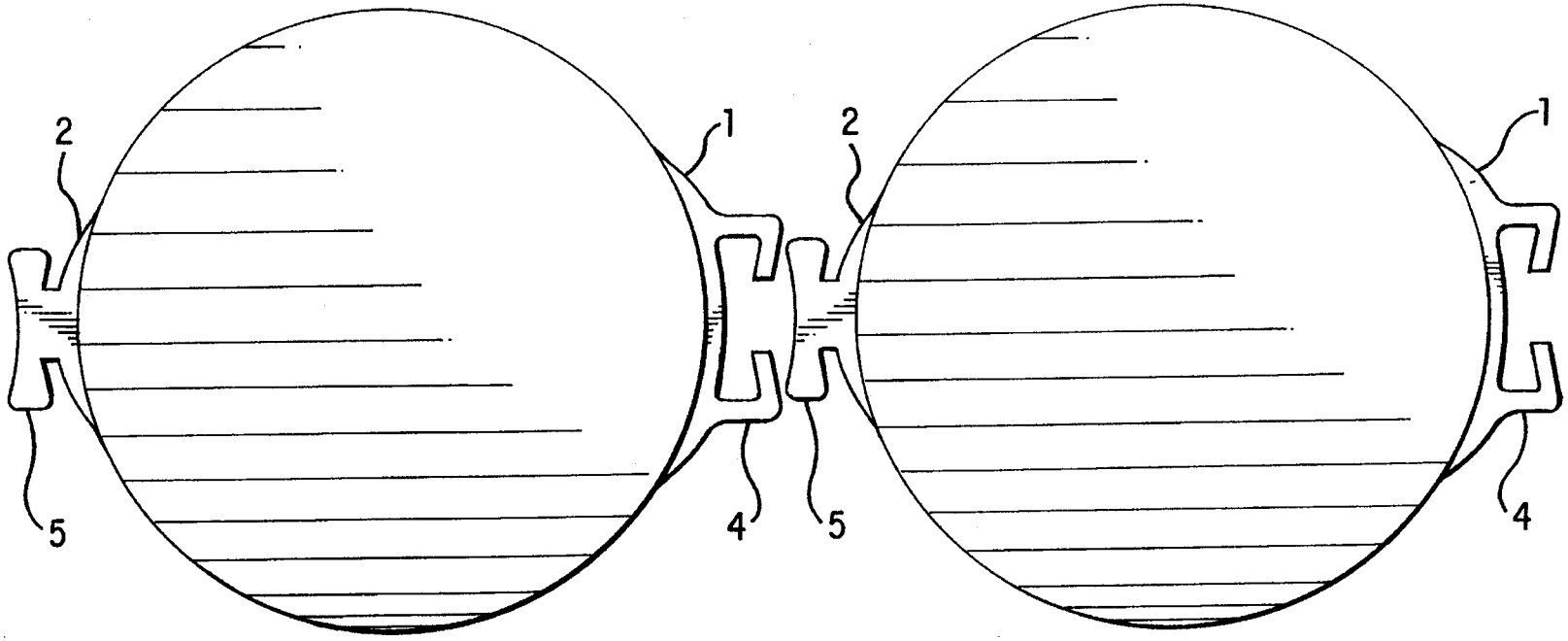
FIG. 2 shows a cross section through two parallelly arranged floats according to the invention with joining means attached thereto in the form of a T-shaped key and a slot adapting thereto.
Figure 3:
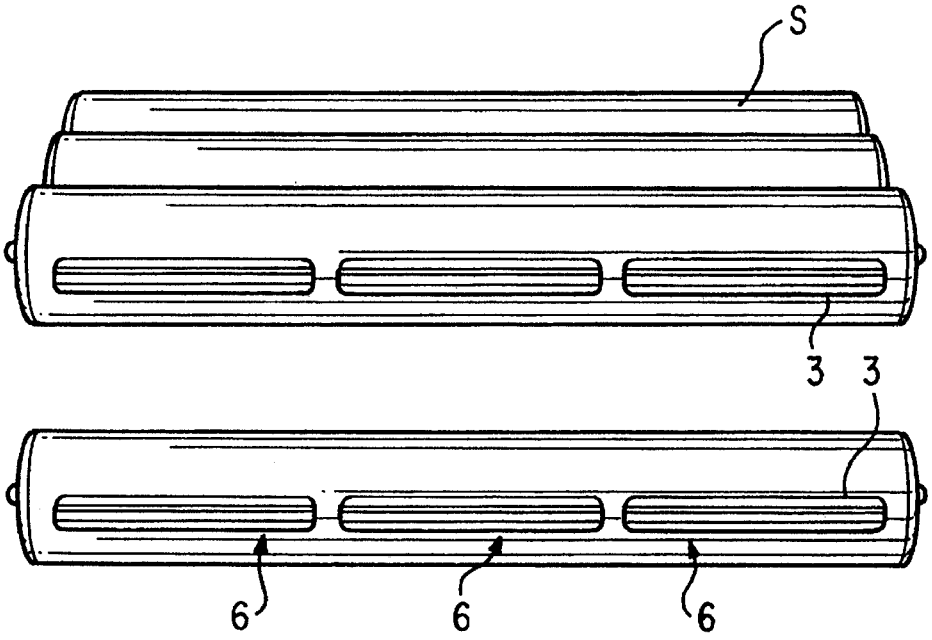
FIG. 3 shows a side view in perspective of three joined floats and one free float with joining means according to the invention.

FIG. 2 represents the cross section of two floats, which have as joining means on one longitudinal side (2), a key (5) with T-shaped cross section, and on the opposite-lying longitudinal side (1), a correspondingly shaped slot (4). Slot and key, preferably formed as an extruded profile of plastic or rubber, extend essentially over the entire length of the float, whereby, in particular, the possibility shown in FIG. 3 exists of dividing joining means (3) into segments (6). As shown in FIG. 3, several floats (S) according to the invention can be joined into a raft on their longitudinal sides by means of joining means (3). The division of joining means (3) into segments (6) facilitates the assembly or disassembly of the raft.

Figure 4:
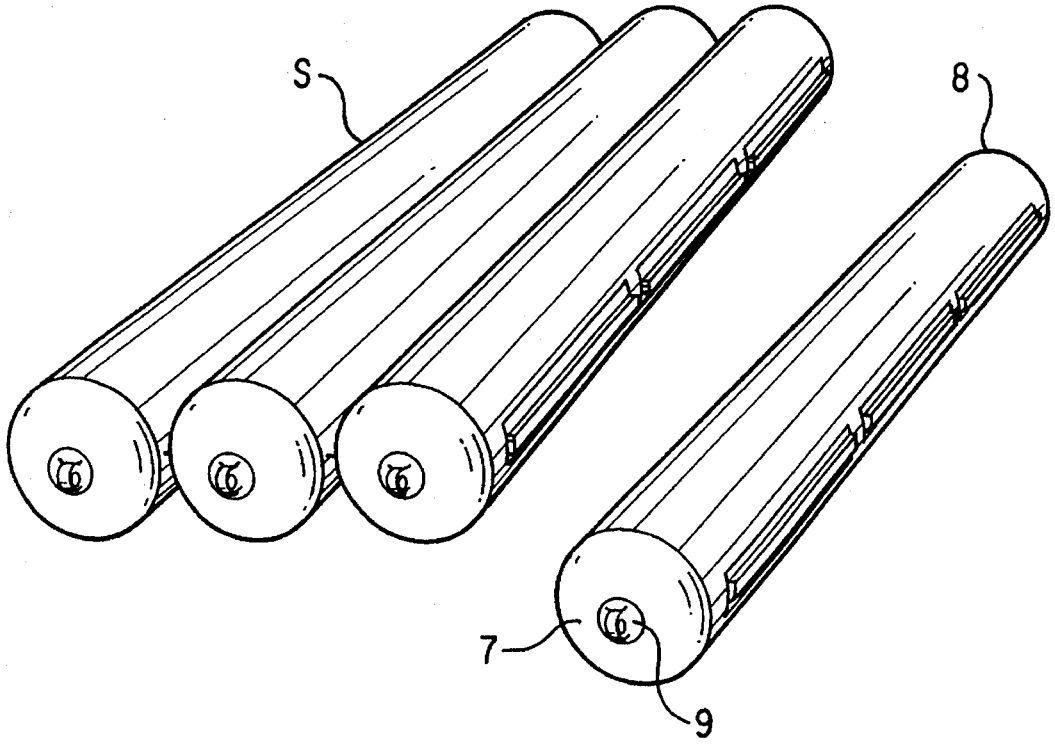
FIG. 4 shows a perspective view of a raft according to the invention and a free float.

FIG. 4 shows a representation of a raft in perspective, which is formed of several individual floats, which are joined tightly by means of joining means (3). In addition to the raft, a free float is shown in a position just prior to incorporation into the raft. The floats have attachment means (9) on front sides (7 and 8). In this way, two or more rafts can be joined together or a raft can be joined to land or to an anchor. In FIG. 4, there are eyes for the front-side attachment means. By means of these, a rope, e.g., can be introduced and guided around the entire raft, and therefore the assembly of the floats into the raft is further improved.

Figure 8:
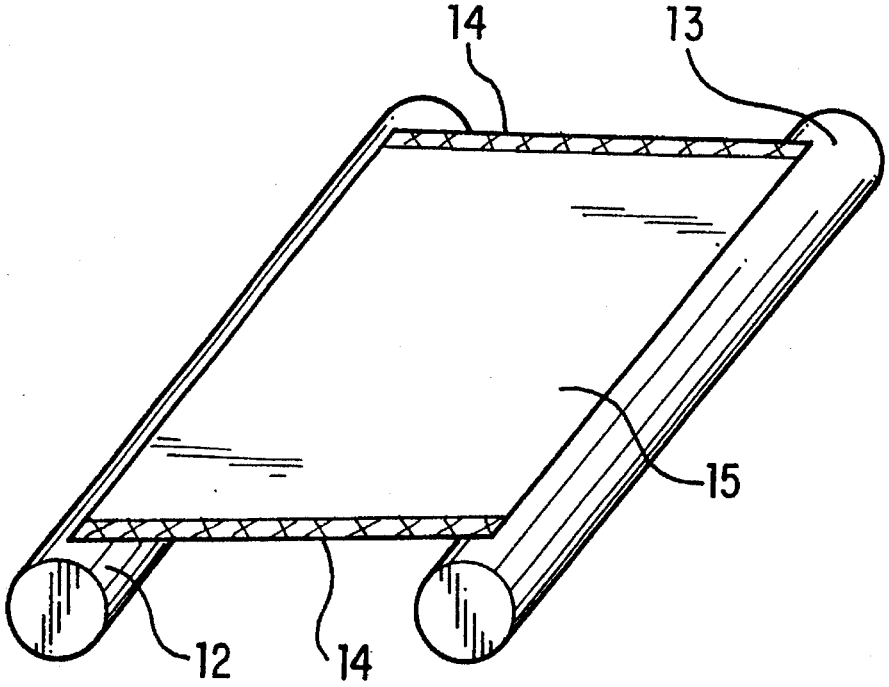
FIG. 8 shows two floats according to tile invention, which are joined together by rigid spacers.

Another form of embodiment of a raft is represented in FIG. 8. Two floats with circular cross section are joined at their front and back ends (12, 13) by a rigid spacer (14). The spacers are introduced onto the floats in such a way that a bottom plate (15) or a roof can be attached to them, whereby a bridged structure results, which is similar to the body of a catamaran.

Particularly advantageous joining means (3) are shown in FIG. 5. Here, there are two identical extruded profiles. Each has approximately the shape of a non-uniform leg of the U in cross section. This U profile has a planar back piece (16), with which it is attached to the side wall (1,2) of the float, e.g., by gluing. In the central region of back piece (16) the latter is clearly reinforced. This reinforcement extends as a band in the direction of extrusion and forms the long leg (17) of the U profile. This long leg (17) changes into bottom (18) of the U profile and then into short leg (19) at one end. On the other end, in the region of the opening of the "U", the long leg (17) has a fin-type projection (20), which shields the open side of the "U". Two such profiles are shown engaged in FIG. 5. This type of joining of two floats has the great advantage that only one profile type and therefore only one extruding mold is necessary for its production.

FIG. 6 shows the cross section of a T-shaped double-key profile (10). Floats, which have a correspondingly shaped attachment slot (4) on both sides (1, 2), are joined together by inserting a double-key profile in each of the two fastening slots turned toward each other.

FIG. 7 shows the cross section of a double-slot profile (11 ), which is formed corresponding to the T-shaped attachment keys (5). Floats, which have a T-shaped attachment key (5) on both sides (1,2) are joined together by insertion of two attachment keys turned toward each other in a double-slot profile.

We claim:

1. A longitudinally extended float, comprising joining means on a first float for detachable longitudinal-side attachment to a substantially identical second float, said joining means being connected to respective opposite first and second longitudinal sides of said first float, said joining means comprising elongated profiles extending substantially parallel to said respective opposite first and second sides, each of the profiles having a generally U-shaped cross-section with leg portions of unequal length, the unequal leg portions comprising a long leg and a short leg, the long leg comprising a back piece which is attached to a respective longitudinal side of said first float, said long leg being connected to said short leg by a bottom portion of said U-shaped profile, said U-shaped profile having an open end opposite the bottom portion, said joining means further comprising a fin member adjacent the open end of said U-shaped profile and substantially parallel to said bottom portion, said fin member being connected to said back piece, and said fin member shielding the open end of the U-shaped profile.

2. The float of claim 1, wherein said joining means extend substantially entirely along said first and second sides.

3. The float of claim 2, wherein said joining means is made up of longitudinally extending segments comprising said elongated profiles, which segments can be engaged with corresponding segments on at least one other float.

4. The float of claim 1, wherein said joining means is made up of longitudinally extending segments comprising said elongated profiles, which segments can be engaged with corresponding segments on at least one other float.

5. The float of claim 4, wherein said float is inflatable.

6. The float of claim 1, wherein said float is inflatable.

7. The float of claim 2, wherein said float is inflatable.

8. A raft comprising the longitudinally-extended float of claim 1, detachably joined to a substantially identical float.

9. The raft of claim 8, wherein each said float is inflatable.

10. The raft of claim 9, including at least two said floats joined at least at front and rear ends thereof by corresponding rigid spacer members extending between respective ends of said at least two floats, said raft further including a roof member, connected to and extending between said rigid spacer members.

11. The raft of claim 8, including at least two said floats joined at least at front and rear ends thereof by corresponding rigid spacer members extending between respective ends of said at least two floats, said raft further including a roof member, connected to and extending between said rigid spacer members.

12. The raft of claim 8, including at least two said floats joined at least at respective front and rear ends thereof by corresponding rigid spacer members extending between respective ends of said at least two floats, said raft further including a bridge member, connected to and extending between said rigid spacer members so as to form a bottom plate of said raft.

13. The raft of claim 9, including at least two said floats joined at least at respective front and rear ends thereof by corresponding rigid spacer members extending between respective ends of said at least two floats, said raft further including a bridge member, connected to and extending between said rigid spacer members so as to form a bottom plate of said raft.

* * * * *